United States Patent [19]

Lovisetto

[11] Patent Number: 4,720,242

[45] Date of Patent: Jan. 19, 1988

[54] CENTRIFUGAL PUMP IMPELLER

[75] Inventor: Primo Lovisetto, Vicenza, Italy

[73] Assignee: Lowara, S.p.A., Italy

[21] Appl. No.: 28,976

[22] Filed: Mar. 23, 1987

[51] Int. Cl.[4] ..... F04D 29/22; F04D 29/66

[52] U.S. Cl. ..... 416/186 A; 416/132 R; 415/140

[58] Field of Search ..... 416/186 R, 186 A, 241 A, 416/132 R, 133; 415/140, 141, 53 R

[56] References Cited

U.S. PATENT DOCUMENTS

| | | | |
|---|---|---|---|
| 991,134 | 5/1911 | Capell | 416/181 |
| 2,882,829 | 4/1959 | Wade . | |
| 2,927,536 | 3/1960 | Rhoades | 416/186 A |
| 2,978,989 | 4/1961 | Lung | 415/140 |
| 3,010,247 | 11/1961 | Shapiro . | |
| 3,116,696 | 1/1964 | Deters | 415/140 |
| 3,165,257 | 1/1965 | Edwards . | |
| 3,298,444 | 1/1967 | Haas . | |
| 3,381,617 | 5/1968 | Wright . | |
| 3,407,740 | 10/1968 | Samerdyke | 415/140 X |
| 3,612,716 | 10/1971 | Deters | 415/140 |
| 3,749,520 | 7/1973 | Bandukwalla | 416/181 X |
| 3,801,226 | 4/1974 | Bevan et al. | 416/241 B |
| 3,958,894 | 5/1976 | Rowley et al. | 415/53 R |
| 4,207,025 | 6/1980 | Reynolds et al. | 415/200 |
| 4,239,453 | 12/1980 | Hergt et al. | 415/182 |
| 4,496,281 | 1/1985 | Noack | 415/111 |
| 4,556,364 | 12/1985 | Barker | 415/170 A |

FOREIGN PATENT DOCUMENTS

| | | | |
|---|---|---|---|
| 576096 | 5/1933 | Fed. Rep. of Germany | 415/141 |
| 858284 | 12/1952 | Fed. Rep. of Germany | 416/186 |
| 875984 | 5/1953 | Fed. Rep. of Germany | 416/181 |
| 1045593 | 12/1958 | Fed. Rep. of Germany | 415/141 |
| 2219417 | 10/1973 | Fed. Rep. of Germany | 416/186 A |
| 45796 | 3/1985 | Japan | 415/140 |
| 97927 | 5/1961 | Netherlands | 416/181 |
| 290437 | 6/1965 | Netherlands | 416/186 R |
| 942648 | 11/1963 | United Kingdom | 416/181 |

*Primary Examiner*—Everette A. Powell, Jr.

*Attorney, Agent, or Firm*—Lerner, David, Littenberg, Krumholz & Mentlik

[57] ABSTRACT

An impeller for a centrifugal pump is disclosed for attenuating the effects of pressure and flow surges experienced by the pump. The impeller includes a rotatable impeller shaft to which a plurality of circumferentially-spaced vanes are mounted for rotation therewith, the vanes extending outwardly relative to the impeller shaft and each including first and second axially spaced edges. First and second axially-spaced cover members are provided for the plurality of vanes, the cover members being mounted for rotation with the impeller shaft and extending outwardly relative to the axial direction of the impeller shaft. The first cover member is disposed adjacent to first edges of the vane and the second cover member is disposed adjacent to second edges of the vane so as to provide an impeller chamber between the first and second cover members which is divided into subchambers by the vanes. One of the cover members includes a centrally disposed opening therethrough for admitting into the impeller chamber to then be conducted outwardly upon rotation of the impeller shaft. Also, the first cover member is constructed and mounted relative to the vanes so that a portion thereof is free to flex axially away from respective portions of the first edges of the vanes in response to fluid pressure pulsations within the impeller chamber to temporarily increase the distance between the portion of the first cover member and the respective portions of the first edges of the vanes.

23 Claims, 7 Drawing Figures

CENTRIFUGAL PUMP IMPELLER

FIELD OF THE INVENTION

The present invention is directed to centrifugal pumps, and more particularly, to an improved impeller for centrifugal pumps which serves to attenuate or eliminate the effects of pressure and flow surges experienced by the pump, such as might result from cavitation, internal recirculation at reduced flow operations and the like. Still more particularly, the present invention relates to a centrifugal pump impeller of the closed type in which the impeller chamber is formed between axially-spaced cover members and in which a plurality of vane members are disposed therebetween to subdivide the impeller chamber into a plurality of subchambers.

BACKGROUND OF THE INVENTION

Centrifugal pumps generally comprise a driven impeller which rotates within a pump casing or body. The impeller generally carries a number of blades or vanes which extend outwardly from the axis of rotation and which serve to force the fluid drawn into the impeller outwardly into the casing or pump body, thereby creating a suction at the central area which serves to draw fluid along an axial direction into the inlet of the impeller and delivering the fluid to the outlet at a higher peripheral velocity. Generally, the pump casing or body includes a volute, diffuser, or other system for converting the higher velocity fluid into a pressure head.

In many situations, particularly with respect to centrifugal pumps which are designed to operate within a wide range of capacities, the fluid being pumped is subjected to cavitation because of the system where the pump is included or by virtue of, for example, operating at part load conditions. In other situations, such as, for example, when a centrifugal pump is operated at reduced flows, strong internal recirculation can be generated. Both cavitation and internal recirculation result in fluid pressure pulsations which frequently can lead to rapid destruction or, at the very least, extensive wear of the various component parts of the pump, such as, for example, pump bearings, the impeller shaft and/or impeller vanes, thus limiting the useful life of the pump. Generally, the undesirable effects of cavitation and/or internal recirculation at part load operations are more pronounced in larger centrifugal pumps, and the wear and/or damage owing to such conditions can increase with increasing rotational speeds of the impeller.

Numerous efforts have been made to reduce the wear or damage attributable to such problems. Some of the more common attempted solutions have included limiting the interval of operation of the pumps in part load regions, utilizing highly wear-resistant materials for those parts which are most likely to be affected and/or providing inserts which are installed in regions where the effect of cavitation and/or internal recirculation are most likely to induce rapid wear or destruction and to provide for replacement of such inserts at regular intervals or when the need arises.

Another attempted solution for minimizing or reducing the effects of cavitation-induced erosion is disclosed in U.S. Pat. No. 4,239,453. In accordance with this patent, the centrifugal pump is provided with an annular diffuser element installed upstream of the intake or inlet to the impeller. The diffuser has a relatively small cross-sectional flow area remote from the intake to the impeller, which progressively increases in cross-sectional flow area towards the inlet to the impeller. The purpose for this arrangement, as disclosed in the patent, is to reduce the effect of eddy currents created at reduced rates of flow, which the patentee thereof believed to be one of the major causes of cavitation.

Impellers used in centrifugal pumps are generally of two types--namely, open-faced and closed. In open-faced types of impeller designs, the edges of the vanes or blades which are remote from the inlet to the impeller are secured to a shroud plate or rear disc member so that the vanes extend substantially at right angles to the surface thereof towards the inlet to the impeller. An impeller of the closed type includes an additional shroud plate or disc member secured to the edges of the vanes nearest the inlet of the impeller so as to provide an impeller chamber bounded by the two spaced shroud plates, with the vanes dividing the impeller chamber into subchambers. The second shroud plate or disc member includes a central aperature in register with the inlet port of the pump to permit fluid entering therethrough to enter between the two shroud plates and to then be thrown outwardly upon rotation of the impeller and the vanes associated therewith. Examples of closed-type impeller constructions are shown in U.S. Pat. Nos. 2,882,829 and 4,556,364, as well as U.S. Pat. No. 4,239,453.

In such prior art closed impeller constructions, both of the shroud plates or disc members are secured to the edges of the vanes throughout substantially their entire radial extent. It will thus be appreciated that with such closed impeller constructions, there is no cross-communication of fluid between the various subchambers within the immpeller chamber, i.e. fluid introduced into any of the subchambers remains in such subchamber until it is expelled from the impeller. Thus, in such closed impeller constructions, fluid pressure pulsations, due to the effects of cavitation, reduced flow or as a result of other conditions, act upon a substantially rigid impeller structure. Consequently, the effects of pressure and flow surges can often be more pronounced in such closed impeller structures.

SUMMARY OF THE INVENTION

In accordance with the present invention, there is provided an improved impeller construction for minimizing these and other disadvantages of the prior art, and in particular, for minimizing the effects of fluid pressure pulsations experienced within centrifugal pumps such as might be due to cavitation, internal recirculation or other similar conditions. The impeller of the present invention comprises a rotatable impeller shaft having a plurality of circumferentially-spaced vanes mounted for rotation therewith, the vanes extending outwardly relative to the impeller shaft and each including first and second axially-spaced edges. First and second axially-spaced cover members are provided for the plurality of vanes, the cover members being mounted for rotation with the impeller shaft and extending outwardly relative to the axial direction of the impeller shaft. The first cover member is disposed adjacent to the first edges of the vanes and the second cover member is disposed adjacent to the second edges of the vanes so as to provide an impeller chamber between the first and second cover members which is divided into subchambers by the vanes. One of the cover members includes a centrally disposed inlet opening therethrough for admitting fluid into the impeller chamber which is then to be conducted radially outwardly upon rotation of the impeller shaft. The first cover member is so constructed and mounted relative to the vanes that a portion thereof is free to flex or move axially away from respective portions of the first edges of the vanes in response to fluid pressure pulsations within the impeller chamber to temporarily increase the distance between the flexing portion of the first cover and the respective portions of the first edges of the vanes. Such an arrangement minimizes the effects of cavitation and/or recirculation, thus providing for a prolonged life expectancy of the impeller, while at the same time providing a very high efficiency for the pump.

In this regard, it is believed that the temporary increase in the distance between the expanding or flexing portion of the cover member and the respective portions of the edges of the vane serves to provide a temporary passageway between the cover member and the respective portions of the edges of the vanes to thereby permit a limited quantity of fluid in one of the subchambers to pass into an adjacent subchamber through the passageway. It is believed that such limited cross-communication between the subchambers reduces or attenuates the effects of pressure and flow surges appearing within the pump, such as might be due to cavitation, recirculation or other factors and conditions. In any event, with the impeller construction of the present invention, the adverse effects of pressure pulsations such as due to cavitation and/or recirculation are minimized, whereby the life of the impeller can be greatly increased.

In accordance with a preferred embodiment, the first cover member includes the centrally-disposed opening therein for admitting fluid into the impeller chamber, and the second cover member is fixedly secured to the second edges of the vanes. Further, is central inlet defining ring is secured to the vanes so as to be coaxially arranged with respect to the impeller shaft, and the first cover member comprises an annular-shaped cover member. In this manner, the inlet defining ring extends through the central opening of the first cover member and serves to locate and position the first cover member relative to the first edges of the vanes. Preferrably, the inner central portion of the annular-shaped cover member is held in position relative to the first edges of the vanes, with the radially outer portion thereof being free to flex or move away from the edges of the vanes in response to fluid pressure pulsations. Conveniently, this can be accomplished by provision of a press ring coupled to the inlet defining ring, and arranged to engage the inner circular edge of the annular cover member to maintain same in position relative to the inlet defining ring.

Further in accordance with a preferred embodiment, the front cover member may normally be maintained in contact with the first edges of the vanes substantially throughout the radial extend of the vanes, or may be positioned so as to be spacedly positioned therefrom a small extent along the radial extent of the vanes and front cover member. With either embodiment, the presence of fluid pressure pulsations, such as due to cavitation, internal recirculation or other conditions, serves to cause a radially outward portion of the cover member to move away from respective portions of the first edges to thereby temporarily increase the distance between such portion of the cover and the respective portions of the edges of the vanes. Preferrably, in embodiments wherein the cover member does not fully contact the edges of the vanes, the surface of the cover member facing the edges is provided with recesses arranged so that said edges of said vanes are aligned with and received in the recessed portions in the surface of the cover member.

In accordance with another aspect of the present invention, there is provided a centrifugal pump which includes an impeller in accordance with the present invention which has a cover member constructed and mounted relative to the vanes so that a portion thereof is free to flex away from respective portions of edges of the vanes in response to fluid pressure pulsations within the impeller chamber. In accordance with this aspect of the present invention, the centrifugal pump also includes a pump housing having an inlet and an outlet, and the impeller is mounted for rotation in the housing between the inlet and the outlet for directing fluid from the inlet to the outlet of the housing.

DESCRIPTION OF A PREFERRED EMBODIMENT

Figure 1:
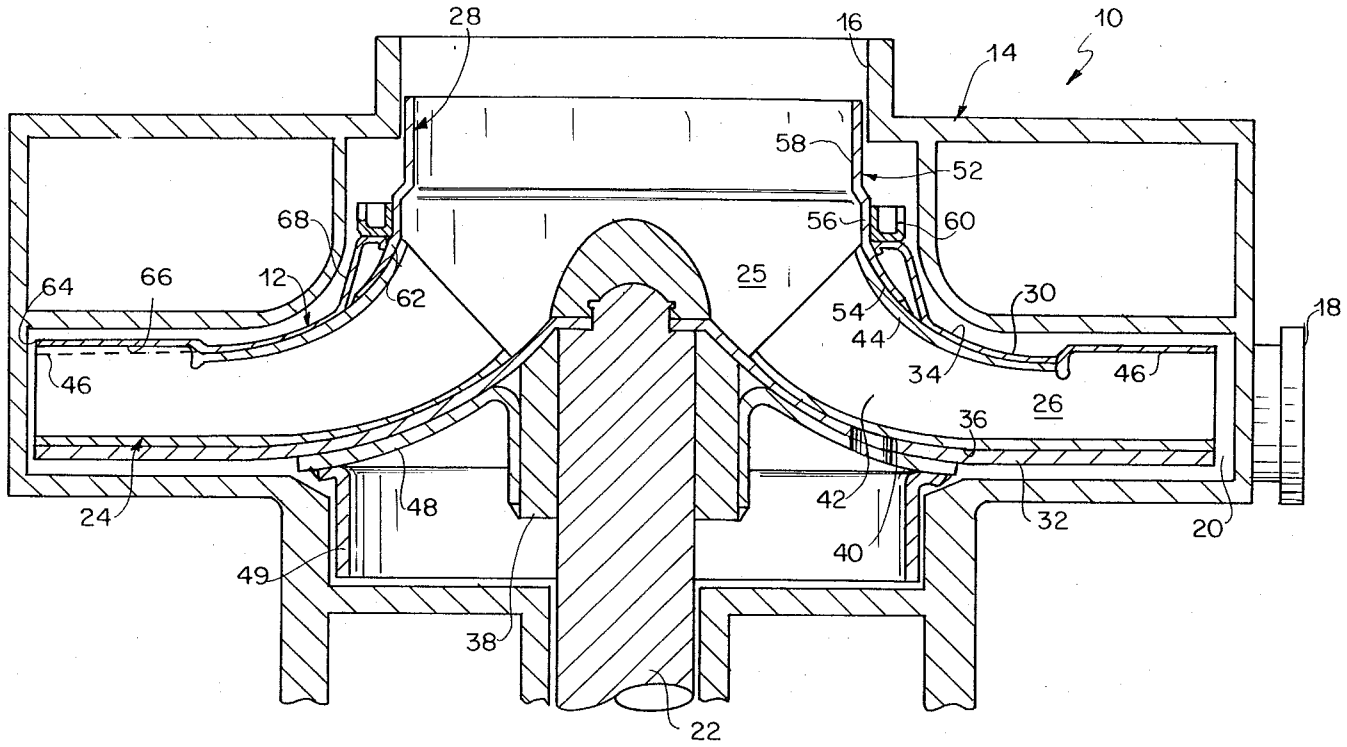
FIG. 1 is a cross-sectional view of a centrifugal pump in accordance with the present invention, illustrating one embodiment of an impeller according to the present invention mounted for rotation within a pump housing.

Referring now to the drawings wherein like reference characters represent like elements, there is shown in FIG. 1 a centrifugal pump 10 employing an impeller 12 in accordance with the present invention. As illustrated in FIG. 1, the centrifugal pump 10 comprises a pump casing or housing 14 in which the impeller 12 is mounted for rotation. The pump casing or housing 14 is provided with an inlet opening 16 and a discharge opening 18, with fluid to be pumped being introduced at the inlet 16 at a first pressure and exiting at the outlet 18 at a higher second pressure. As is well known, the increase in pressure is provided by the impeller 12 increasing the velocity of the fluid and then converting the velocity head into a pressure head. The housing 14 of the centrifugal pump 10 need not be in any particular form or construction in accordance with the present invention. For instance, the pump housing 14 may include a volute, a diffuser, or other system or means for converting the velocity imparted to the fluid into a pressure head.

The impeller 12 of the centrifugal pump 10 is mounted within the pump housing 14 for rotation about a central axis which is aligned with the inlet 16. In this regard, the impeller 12 is secured in a suitable manner to a rotatable shaft 22 which is rotatably supported in the housing 14. Suitable packings (not shown) may be provided to seal around the shaft 22 where it extends into the housing 14. As is well known, the other end of the shaft 22 is connected to a motor or other driving device (not shown) for rotating the shaft 22, and hence, the impeller 12 at relatively high speeds.

The impeller 12 in accordance with the present invention is generally of the closed type having an internal impeller chamber 25 divided into a plurality of subchambers 26 by means of impeller blades or vanes 24. The impeller 12 includes a centrally disposed inlet opening 28 aligned with the inlet opening 16 in the pump housing 14 for admitting fluid to be pumped into the impeller chamber 25. Upon rapid rotation of the impeller 12 and the vanes 24 associated therewith, liquid is drawn through the central opening 28 into the impeller chamber 25 and thrown outwardly into an annular chamber 20 adjacent the periphery of the impeller 12 and then discharged through the outlet opening 18 of the pump housing 14, which may, as shown in FIG. 1, be connected tangentially with the annular chamber 20.

Figure 2:
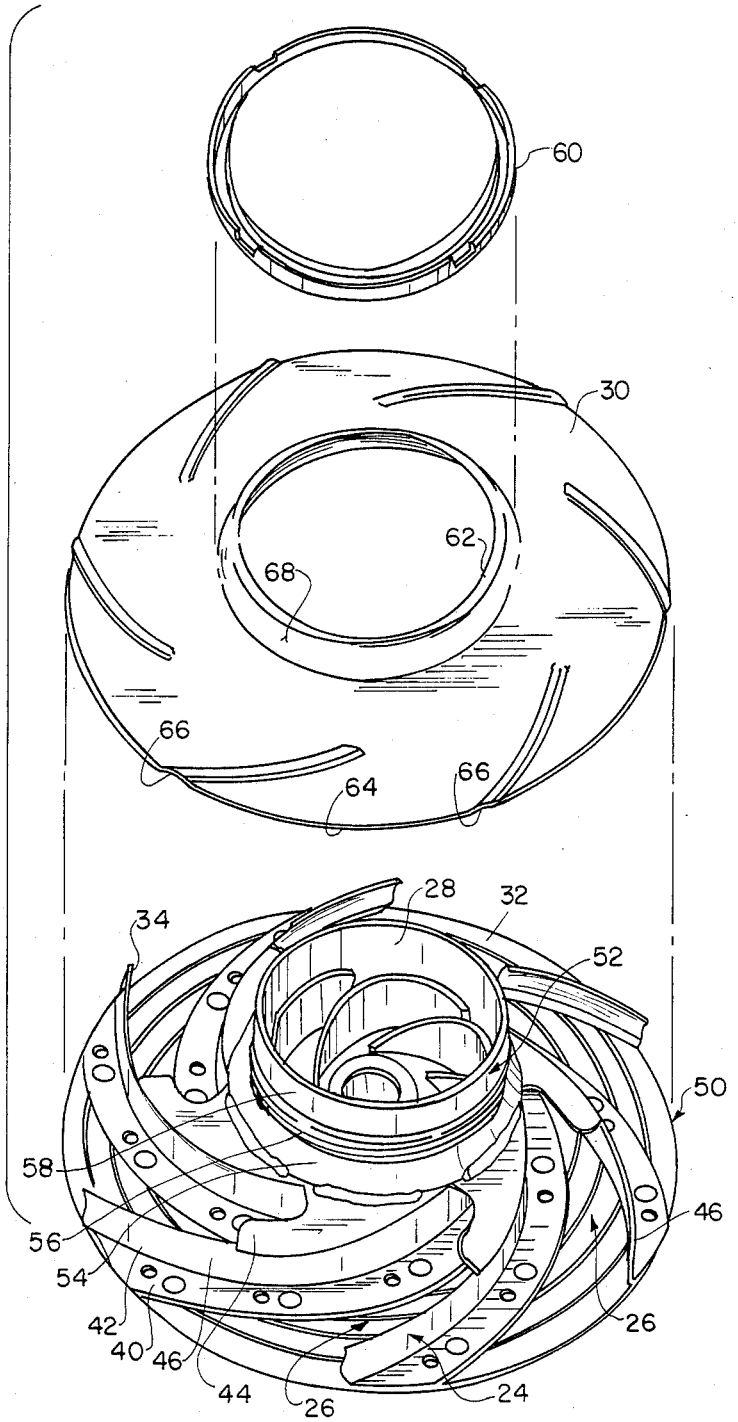
FIG. 2 is an exploded perspective view of the embodiment of the impeller in accordance with the present invention which is shown in FIG. 1.

As best seen in FIGS. 1 and 2, the impeller 12 in accordance with the present invention includes front and back cover members or shrouds 30, 32 on opposite sides of the vanes 24 for defining the impeller chamber 25, the front cover 30 being provided with a cylindrical opening 62 through which fluid may be admitted into the impeller chamber 25. As discussed more fully hereinbelow, the front cover 30, at its radially outer extent, is not fixedly secured to the forward edges 34 of the vanes 24, but rather, is mounted so as to be free to expand or flex away from the forward edges 34 of the vanes 24 in response to fluid pressure pulsations experienced within the impeller chamber 25. Such temporary expansion or flexing away from the forward edges 34 of the vanes 24 of the impeller 12 serves to minimize the adverse effects generally created in centrifugal pumps due to fluid pressure pulsations, such as might result from cavitation, internal recirculation at part load conditions, or as a result of other reasons such as, for instance, water hammer, sudden stoppage during startup and/or loss of driving power, and the like. It is believed that such flexing or movement of the front cover 30 away from the edges 34 of the vanes 24, which occurs at the radially outward or peripheral portions of the front cover 30, serves to provide a temporary passageway for enabling cross-communication of fluid within the impeller chamber 25 to pass from one side of the vanes 24 to the other side, i.e. provide for cross-communication between the subchambers 26 defined by the vanes 24. By minimizing or attenuating the effects of pressure and flow surges within the impeller 12, the adverse effects of cavitation and/or recirculation which have heretofor destroyed or led to the rapid wear and destruction of impellers, are minimized, or eliminated, thus greatly prolonging the life expectancy of the impeller, while at the same time, guaranteeing high efficiency for the pump 10.

More particularly, in the embodiment shown in FIG. 1, the back cover or shroud member 32 is affixed, such as by welding or other suitable method, to a hub 38 for the impeller shaft 22 which is centrally disposed with respect to the back cover 32. Further, the plurality of vane members 24 are also suitably affixed, along their back edges 36, to the back cover member 32 so as to be circumferentially arranged about the axis of the impeller hub 38. In the embodiment illustrated in FIGS. 1 and 2, the impeller vanes 24 are fabricated from sheet metal, such as stainless steel, to form crescent-shaped elements which each include a bottom flange portion 40 difining a bottom edge 36 of the vane 24, an upstanding flange portion 42 defining the impeller blade portion, and a top flange and upstanding edge portion 44, 46 defining a top edge 34 of the vane 24. As best seen in FIG. 1, both the top and bottom edges 34, 36 of the vanes 24 are each generally concavely shaped. Further, the bottom flange portion 40 extends along the entire length of the vane 24, whereas the top flange portion 44 only extends a part of the radial extent of the vane 24 with the radially outer or peripheral end of the vane 24 having an upstanding edge 46 which extends slightly upward beyond the top flange portion 44 (see FIG. 1).

The bottom flange portion 40 is secured to the back cover member 32 by suitable means, such as by welding. Thus, the back cover 32 and vanes 24 comprise a substantially rigid structure 50 to which the front cover member 30 is to be mounted and secured in accordance with the present invention. An annular inlet ring 52 is also secured to the vane/back cover structure 50 so as to define the inlet 28 to the impeller 12. In this regard, the inlet ring 52 includes an outwardly flared lower segment 54 which may be suitably secured, such as by welding, to the radially inner portions of the top edges 34 of the vanes 24, a cylindrical hub portion 56 which is suitably threaded for a purpose to be described hereinbelow, and a further cylindrical portion 58 which is adapted to be disposed within the inlet opening 16 defined in the pump casing or housing 14. A support ring 48 is also suitably provided and secured to the impeller hub 38 and to the lower central portion of the rear surface of the back cover member 32 to further strengthen the vane/back cover structure 50. An axial thrust ring 49 may also be provided for reducing axial thrust experienced by the impeller 12.

In the embodiment shown in FIGS. 1 and 2, the front cover member 30 comprises a generally annular plate having an inner circular edge 62 and an outer peripheral edge 64. The cross-sectional configuration of the front cover member 30 generally corresponds to the cross-sectional shape defined by the top edges 34 of the vanes 24. It can thus be seen from FIG. 1 that the radially inner portion of the front cover 30 includes a raised hub portion 68. Conveniently, the raised inner central circular edge 62 of the front cover 30 includes an inwardly-turned flange which is adapted to fit over the central hub 56 of the inlet ring 52 secured to the vanes 24. A press ring 60 is provided having internal threads adapted to mate with the external threads on the inlet ring 52 for securely mounting the front cover member 30, at its radially inner end, relative to the vanes 24 and the inlet ring 52. In this regard, the press ring 60 shown in FIGS. 1 and 2 comprises an inverted U-shaped ring. After the cover member 30 is placed over the inlet ring 52, the press ring 60 is threaded thereonto and serves to urge the inner central hub 68 of the front cover 30 into position relative to the vanes 24 and inlet ring 52. By tightening of the press ring 60, the front cover member 30 is urged into perfect contact with the top edges 34 of the vanes 24, as illustrated in FIG. 1. The front cover 30 also includes a plurality of spiral-shaped recesses 66 at the outer peripheral edges thereof for receiving the raised peripheral edges 46 of the vanes 24. Thus, the raised edges 46 are received within the spiral recesses 66 provided in the front cover 30 which serves to properly locate the front cover 30 relative to the vane/back cover structure 50.

The resulting structure for the impeller 12, in which the front cover 30 is urged into perfect contact with the edges 34 of the vanes 24 substantially throughout their radial extent, is the arrangement of components for normal operation of the centrifugal pump 10. It will be appreciated that there normally is no cross-communication of fluid between the various impeller subchambers 26. In this regard, it is to be noted that the front cover 30 is secured to the vane/back cover structure 50 only by means of the central press ring 60, and that no means are provided for fastening or securing the outer peripheral portions thereof to the edges of the vanes 24. However, if the impeller 12 is subjected to the presence of large magnitude fluid pressure pulsations, the outer radial edges of the front cover 30 will temporarily be urged away from the corresponding edges 34 of the vanes 24, and thus, permit cross-communication of fluid within the impeller chamber 25 from one side of the vanes 24 to the other. It is believed that the provision of such temporary cross-communication as a result of the front cover 30 flexing at its radial or peripheral edges away from the vanes 24, even to a limited estent, serves to reduce the magnitude of the pressure pulsations and thus prevent or minimize damage to the impeller 12.

It will be appreciated that the front cover member 30, in order to flex away from the top or forward edges 34 of the vanes 24 in response to pressure and/or flow surges experienced within the impeller chamber 25, must be somewhat flexible or elastic in order to permit a limited degree of expansion of the cover 30 away from the top or front edges 34 of the vanes 24. In the particular construction illustrated in FIGS. 1 and 2, the front cover member 30 is fabricated from relatively thin sheet metal, such as stainless steel. Further, the degree of movement away from the edges 34 ofo the vanes 24 is dependent upon the position at which the forces act upon the cover member 30. Thus, there is no movement of the front cover 30 away from the vanes 24 at the inner cylindrical edge 62 due to the inner edge 62 being clamped between the press ring 60 and the corresponding portion 54 of the inlet ring 52. However, at the outer radial positions of the front cover 30, the front cover 30 is free to move away from the edges 34 of the vanes 24 in response to fluid pressure pulsations experienced within the impeller chamber 25. The degree of elasticity of the front cover member 30 to be provided is dependent upon the thickness of the front cover 30 and the properties of the materials, as well as the diameter of the impeller 12 itself. For instance, for a centrifugal pump having a diameter of 220 millimeters and in which the impeller 12 is rotated by means of a 15 horsepower motor, a one millimeter-thick front cover 30 fabricated from 304/316 stainless steel has provided very satisfactory results. Indeed, such a pump has operated satisfactorily for over 1000 hours whereas similarly-sized pumps of a conventional construction have a useful life generally on the order of 100 hours. For a 250 millimeter-diameter pump operated on by a 100 horsepower motor, a 1.5 millimeter-thick front cover 30 may be utilized. With such constructions, the amount of movement at the extreme dimensions of the impeller diameter in response to typical pressure pulsations will be on the order of about 0.3 millimeters. In terms of the degree of flexibility required, the front cover 30 should be sufficiently elastic that is adapted to provide a limited degree of movement in response to fluid pressure pulsations of sufficient magnitude that they might otherwise damage the impeller. Further, the amount of movement of the front cover 30 should be such as to remain in the elastic range of the material being utilized.

Although the impeller vanes 24 and front and back cover members 30, 32, in the embodiment shown in FIGS. 1 and 2 are fabricated from sheet metal, it will also be appreciated that various other materials could be employed, depending upon the performance requirements for the impeller and the liquid or fluids being handled. For instance, plastic-metallic constructions could be utilized as well as plastic structures. In addition, the impeller components could be manufactured from titanium, stainless steel or other types of ferrous and nonferrous materials. Also, the basic impeller body 50, i.e. the vanes 24 and back cover member 32, could be fabricated from solid material such as cast iron, cast stainless steel, bronze, or plastic. Preferrably, the front cover member 30 is fabricated from a sheet material such as a stainless steel sheet which is formed into an appropriate shape dependent upon the shape of the vanes 24 and other components of the impeller 12.

Figure 3:
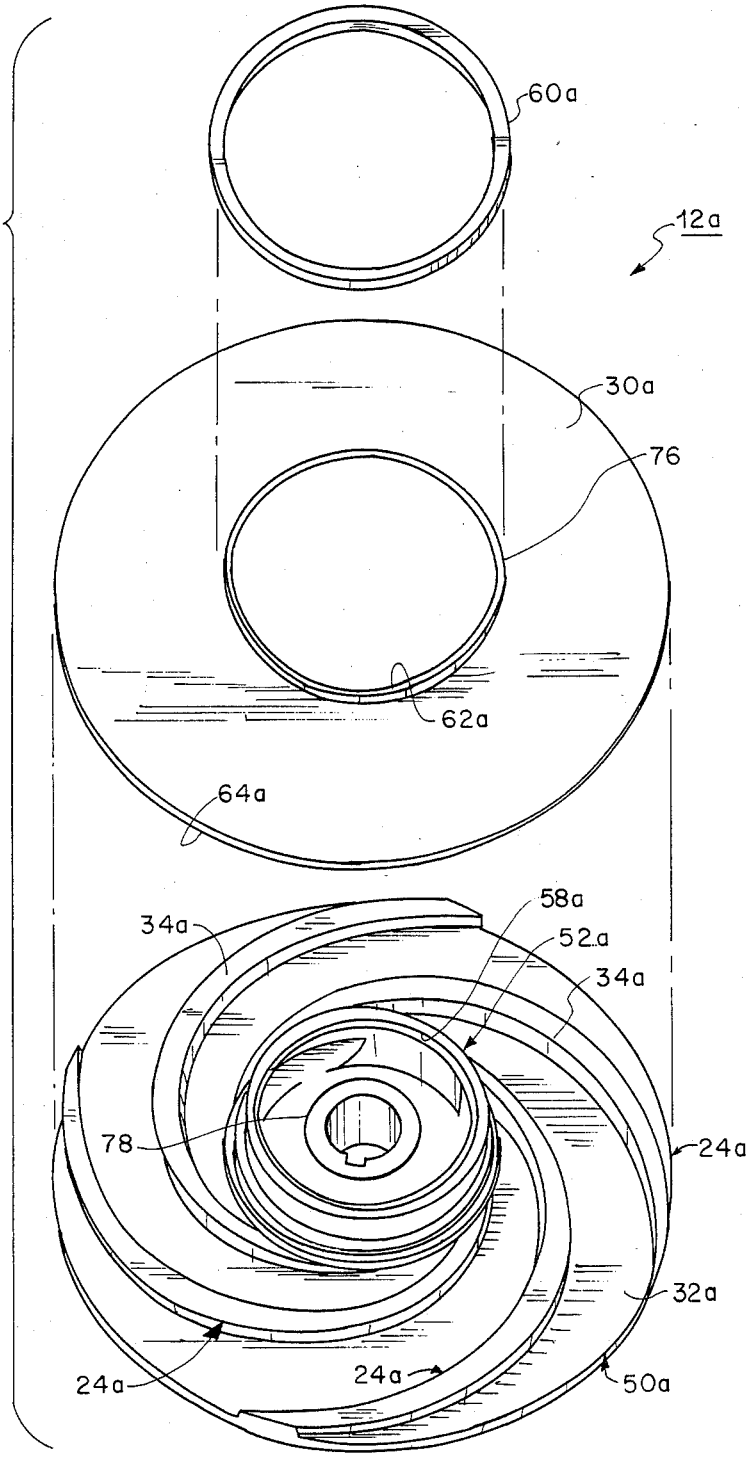
FIG. 3 is an exploded perspective view of a modified form of impeller construction in accordance with the present invention.
Figure 4:
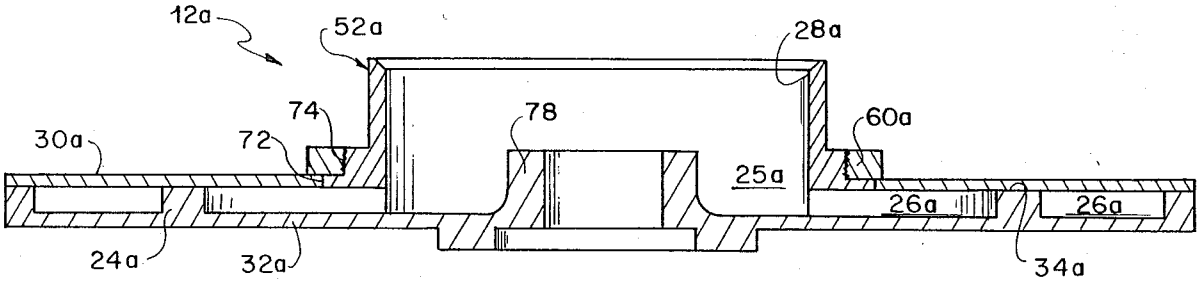
FIG. 4 is a cross-sectional view of the modified form of impeller construction illustrated in FIG. 3 when same is fully assembled.

An example of a cast impeller body **50*a* is illustrated, for instance, in FIGS. 3 and 4 in which the back cover 32*a* and vane 24*a* components are integrally formed as a single element. More particularly, in accordance with this embodiment, the plurality of spiral-shaped vanes 24*a*, namely, four in number, are integrally formed on a back cover member 32*a*, such as by casting, and then the surface thereof suitably finished. An inlet defining ring 52*a* is suitably secured to the central portion of the top edges 34*a* of the vanes 24*a*, such as by welding or the like. In the embodiment shown in FIG. 3, the inlet ring 52a includes a pair of stepped shoulders 72, 74, the radially outermost shoulder 72 serving to act as a locating shoulder for the front cover 30*a* and the raised inner shoulder 74 being threaded for receiving a securing or press ring 60*a*. In this embodiment, the front cover 30*a* is provided by a relatively thin, for example, one millimeter-thick stainless steel sheet, and has a raised locating hub 76. In assembly, the front cover 30*a* is located in position by means of the shoulder 72 and then securely held, at its inner cylindrical edge 62*a*, by means of a threaded press ring 60*a* threadably coupled to the threaded shoulder or hub 74 of the inlet ring 52*a*. In this embodiment, the impeller shaft mounting hub 78 also extends above the surface of the back cover 32*a* a slight extent. When mounted in a suitable pump housing or casing, fluid is drawn inwardly in the central portion of the impeller 12*a* and then urged outwardly beneath the lower edge of the inlet ring 52*a* welded or affixed to the upper edges 34*a* of the vanes 24*a*. As with the embodiments shown in FIGS. 1 and 2, in response to fluid pressure pulsations of large magnitude, the radially outward edges of the front cover 30*a* will temporarily raise or move away from the top edges 34*a* of the vanes 24*a* to permit cross-communication between the various subchambers 26*a* defined by the vanes 24*a***.

Although in the embodiments shown in FIGS. 1–4 the front cover members 30, **30*a* of the impellers 12, 12*a* are in precise direct contact, during normal operation, with the edges 34, 34*a* of the vanes 24, 24*a*, such full contact between the covers 30, 30*a* and the vanes 24, 24*a* are not necessary in order to take advantage of the benefits in accordance with the present invention. In this regard, the press rings 60, 60***a* for securing the front covers 30, 30*a* to the inlet rings 52, 52*a* permit a regulation of the pressure of the covers 30, 30*a* on the vane edges 34, 34*a*. If desired, the press rings 60, 60*a* can be backed off slightly to permit a small gap, preferrably on the order of 0.5 millimeters or less, between portions of the inner surface of the front cover 30, 30*a* and the edges 34, 34*a* of the vanes 24, 24*a*. The presence of such a small gap during normal operation does not adversely affect the performance of the impeller 12, 12*a*, and at the same time, will allow for greater elasticity or flexibility of the front cover 30, 30*a*.

Figure 7:
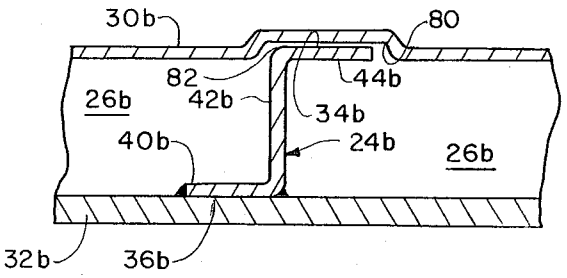
FIG. 7 is a partial cross-sectional view of the modified form of the impeller shown in FIG. 4 taken along line 7—7 of FIG. 4, illustrating the arrangement of the front cover member relative to the vanes and rear cover member.
Figure 5:
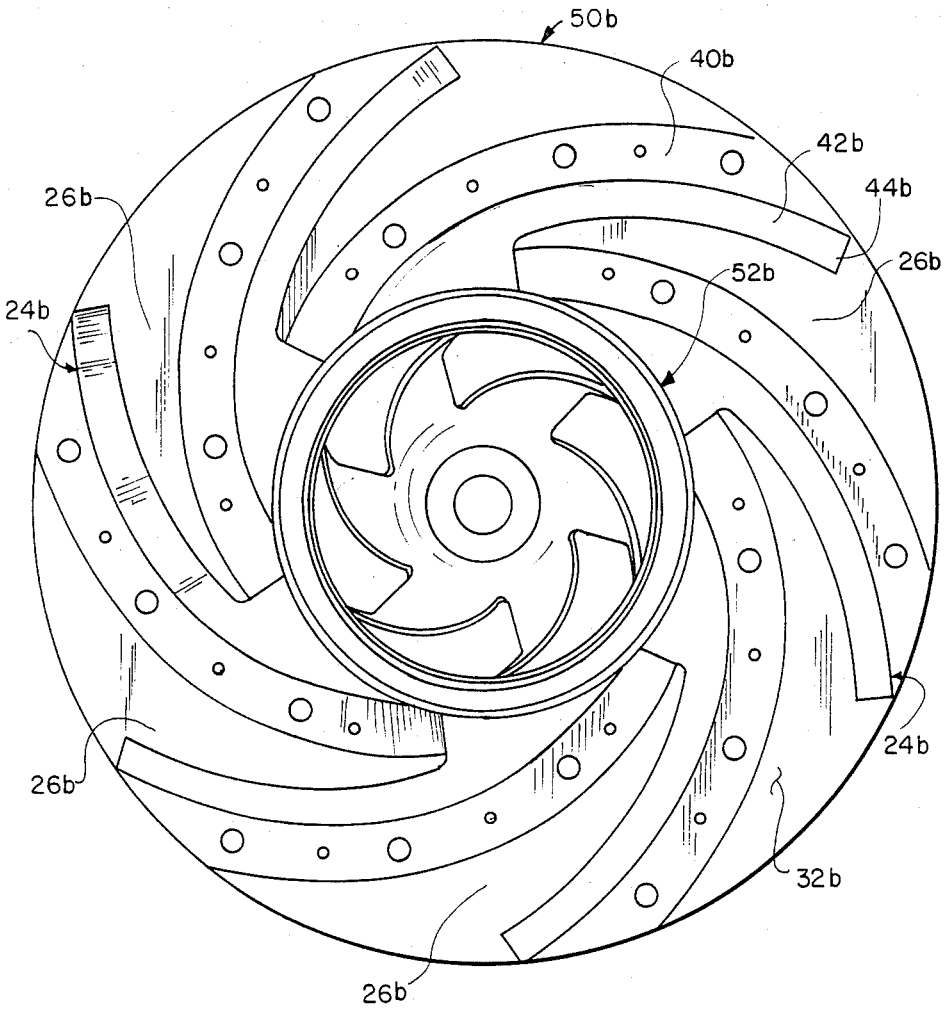
FIG. 5 is a plan view of the vanes and rear cover plate of a further modified form of an impeller in accordance with the present invention.
Figure 6:
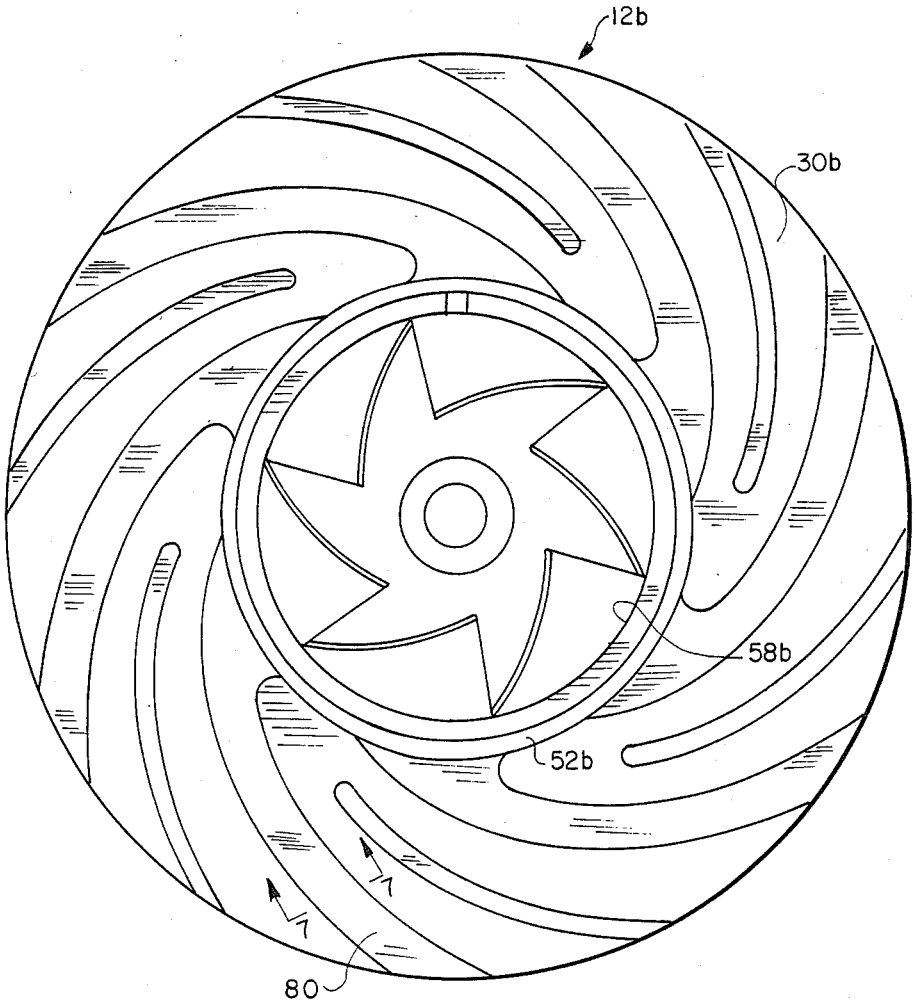
FIG. 6 is a plan view of the modified form of the impeller shown in FIG. 3, illustrating, in particular, the front cover member thereof.

FIGS. 5–7 illustrate a further embodiment of an impeller 12*b* in accordance with the present invention. In accordance with this embodiment, the front cover member 30*b* is provided with a series of recesses 80 along the inner surface thereof for purposes of providing a small space or gap 82 between the top edges 34*b* of the vanes 24*b* and the inner surface of the cover 30*b* during normal operation.

More particularly, in accordance with this embodiment, the impeller body, i.e. the vane/back cover structure 50*b*, is similar in construction to the embodiment shown in FIGS. 1 and 2, with the exception that the top flange portions 44*b* of the vanes 24*b* extend throughout the radial extent of the vanes 24*b*. That is, the top flange portions 44*b* of each vane 24*b* extends from the central region thereof out to the peripheral region thereof. As with the embodiment shown in FIGS. 1 and 2, the cresent-shaped vane members 24*b* are secured to the back cover 32*b* by suitable means, such as by welding. The construction for the front cover 30*b* in accordance with this modified construction is illustrated in FIG. 6. As can be seen from FIG. 6, the front cover 30*b* is fabricated so as to be provided with a series of recesses 80 in the inner surface thereof, which may be conveniently formed by suitable stamping of a stainless steel sheet. The location of the recessed areas 80 corresponds to the location of the top flanged portions 44*b* of the vanes 24*b* so that when the front cover 30*b* is assembled to the vane/back cover structure 50*b*, the top edge portions 44*b* of the vanes 24*b* are aligned with the recessed portions 80 in the cover 30*b* and spaced therefrom to provide a small gap or distance 82 therebetween, for example, on the order of 0.2–0.5 millimeters. This small spacing 82 is illustrated in FIG. 7.

As with the other embodiments, sufficiently large pressure pulsations will serve to cause the cover 30*b* at the radially outermost portions or peripheral edges thereof to raise or increase the spacing 82 between the cover 30*b* and the edges 34*b* of the vanes 24*b*. The increase in the spacing between the cover 30*b* and the vanes 24*b* serves to permit a limited cross flow of fluid from one subchamber 26 to the other to thereby attenuate pressure and flow surges within the impeller 12*b*, and thus, attenuate or minimize possible damage to the impeller 12*b*.

The presence of the small gap 82, on the order of 0.2 to 0.5 millimeters during normal operation, does not adversely affect the efficiency of the pump during normal operation because of the labyrinth-type construction for the flow passage 82. More particularly, the particular structure illustrated for the impeller 12*b* in FIGS. 5–7 is one in which the inner surface of the cover 30*b*, except at the locations of the vanes 24*b*, is below the upper extent of the top flange portions 44*b* defining the top edge 34*b* of the vanes 24*b*, thus creating a labyrinth or tortuous-type path for fluid to flow from one side of the vanes 24*b* to the other side. In other words, during normal operation, the fluid would have to flow up, over and back down over the upper edges of the vanes 24*b*. The presence of such a flow path and construction, while it is a gap, nevertheless minimizes cross-communication between the subchambers 26*b* during normal operation of the pump. At the same time, the presence of the labyrinth-type recesses 80 permit the full action of flexibility of the cover 30*b* in response to fluid pressure pulsations within the impeller 12*b*. Thus, the presence of large pressure fluctuations or pulsations sufficient to flex the cover 30*b* away from the vanes 24*b*, such as might result from cavitation and/or recirculation, serves to provide for a more direct flow passage or cross-communication.

Here it should be noted that the depth of the recess 80 provided in the front cover 30*b* in this embodiment is such that the normal spacing between the top edge 34*b* and the inside surface of the cover 30*b* is on the order of 0.2–0.5 mm. Preferrably, the lower surface of the nonrecessed portion of the cover 30*b* is at an elevation below the top surface of the flanged portions 44*b* of the vanes 24*b*.

It will thus be appreciated that in accordance with the present invention there is provided an impeller 12 of the closed type for centrifugal pumps 10 which minimizes or reduces the adverse effects of cavitation and/or recirculation, or as a result of other pressure and flow surges experienced in centrifugal pumps during operation and which otherwise would damage or cause rapid deterioration of the impeller 12. In accordance with the present invention, the impeller 12 includes a rotatable impeller shaft 22 and a plurality of impeller vanes 24 mounted for rotation therewith. The vanes 24 include first and second axially-spaced edges 34, 36. The impeller 12 also includes first and second cover members 30, 32 for the vanes 24, the cover members 30, 32 being mounted for rotation with the impeller shaft 24 and extending radially outward relative thereto. The first cover member 30 is arranged so as to be adjacet the first edges 34 of the vanes 24 and the second cover member 32 is arranged to be adjacent the second edges 36 of the vanes 24 so as to provide an impeller chamber 25 therebetween which is subdivided by the vanes 24. One of the cover members 30 is provided with a centrally disposed inlet opening 62 therethrough for admitting fluid into the impeller chamber 25. The front cover member 30 is so constructed and mounted that a portion thereof is adapted to flex away from respective portions of the first edges 34 of the vanes 24 in response to fluid pressure pulsations within the impeller chamber 25 to thereby increase the spacing between the cover 30 and the respective portions of the first edges 34 of the vanes 24. Such temporary movement of the cover 30 away from the respective portions of the first edges 34 of the vanes 24 permits fluid within the impeller chamber 25 to pass from one side of the vanes 24 to the other side of the vanes 24, and thus, minimize the adverse affects on the impeller components which might otherwise result. Preferrably, the front cover 30 is secured at a central location to an inlet defining ring 52 secured to the vanes 24 so that the radially outer or peripheral portions of the front cover 30 are free to flex away from the edges 34 of the vanes 24 in response to fluid pressure pulsations created within the impeller chamber 25. The flexing of the portion of the cover 30 away from the vanes 24 serves to permit a limited quantity of fluid to pass from one side of the vanes 24 to the other which is sufficient to reduce the effects of cavitation. Such an arrangement greatly icnreases the prolonged life expectancy of the impeller 12, in that it attenuates the effects of pressure and flow surges appearing in the pump for a variety of reasons, such as cavitation, internal circulation, water hammer, sudden stoppages or loss of driving power and the like. The principles in accordance with the present invention may be used in a variety of applications for various turbines and pump applications or other industrial applications where cavitation and/or recirculation has in the past destroyed or damaged impellers very quickly.

As will be readily apparent to those skilled in the art, the present invention may be used in other specific forms without departing from its spirit or essential characteristics. The preferred embodiments are therefore to be considered as illustrative and not restrictive, the scope of the invention being indicated by the claims rather than the foregoing description, and all changes which come with the meaning or range of equivalents of the claims are therefore intended to be embraced therein.

What is claimed is:

1. An impeller for a centrifugal pump comprising:

a rotatable impeller shaft;

a plurality of circumferentially spaced vanes mounted for rotation with said impeller shaft, said vanes extending outwardly relative to said impeller shaft and each including first and second axially-spaced edges;

first and second axially-spaced cover members for said plurality of vanes, said cover members being mounted for rotation with said impeller shaft and extending outwardly relative to the axial direction of said impeller shaft, said first cover member being disposed adjacent to said first edges of said vanes and said second cover member being disposed adjacent to said second edges of said vanes so as to provide an impeller chamber between said first and second cover members which is divided into sub-chambers by said vanes;

one of said first and second cover members having a centrally disposed inlet opening therethrough for admitting fluid into said impeller chamber to then be conducted outwardly upon rotation of said impeller shaft; and said first cover member being so constructed and mounted relative to said vanes that a portion thereof is free to flex axially away from respective portions of said first edges of said vanes in response to fluid pressure pulsations within said impeller chamber to temporarily increase the distance between said portion of said first cover and said respective portions of said first edges of said vanes.

2. The impeller of claim 1 wherein said second cover member is fixedly secured to said second edges of said vanes.

3. The impeller of claim 2, further including a support ring member for reinforcing said second cover member, said support ring member being secured to the surface of said second cover member opposite from the surface fixedly secured to said vanes.

4. The impeller of claim 2 wherein said vanes and said second cover member are integrally formed.

5. The impeller of claim 1 further including an annular inlet member secured to said vanes so as to be coaxially arranged with respect to said impeller shaft, said annular inlet member including an axial opening therein communicating with the interior of said impeller chamber; and wherein said centrally disposed opening in said one of said first and second cover members is in said first cover member and said first cover member is mounted so that said annular inlet member extends through said centrally disposed opening of said first cover member.

6. The impeller of claim 5 wherein said first cover member comprises an annular cover member having an inner circular edge portion and an outer circular edge portion, and wherein said centrally disposed opening of said first cover member is defined by said inner circular edge portion of said first cover member.

7. The impeller of claim 6 wherein said inner circular edge portion of said first cover member is positioned on said annular inlet member, and further including a press ring coupled to said annular inlet member for holding said inner circular edge portion of said first cover member in position on said annular inlet member.

8. The impeller of claim 7 wherein said press ring is threadedly coupled to said annular inlet member.

9. The impeller of claim 1 further including means for securely holding a radial inner portion of said first cover member in contact against a radially inner portion of said first edges of said vanes so that said portion of said first cover member which is free to flex axially away from said respective portions of said first edges of said vanes comprises a radially outer portion of said first cover member.

10. The impeller of claim 10 wherein said first cover member is normally in contact with a substantial portion of said first edges of said vanes.

11. The impeller of claim 10 wherein said first cover member is shaped so that it normally conforms to and is in contact with said first edges of said vanes throughout the radial extent of said vanes.

12. The impeller of claim 9 wherein said first edges of said vane at a radially outward portion thereof include raised edge portions, and wherein said first cover member includes recessed portions in the surface thereof for receiving said raised edge portions of said vanes.

13. The impeller of claim 9 wherein said first cover member is constructed and mounted relative to said vanes so as to form a small gap between the inner surface of said cover member and said respective portions of said first edges of said vanes during normal operation of said impeller, and so that the size of said small gap at a radially outer portion of said first cover member increases upon flexing of said portion of said first cover member away from said respective portions of said first edges of said vanes in response to fluid pressure pulsations within said impeller chamber.

14. The impeller of claim 13 wherein said first cover member includes recessed portions in the surface thereof which are disposed so as to be in alignment with at least radially outer portions of said first edges of said vanes.

15. The impeller of claim 1 wherein said vanes comprise crecent-shaped vane elements.

16. A centrifugal pump comprising a pump housing having an inlet and an outlet, and an impeller mounted for rotation in said pump housing between said inlet and said outlet for directing fluid from said inlet to said outlet, said impeller including:

a rotatable impeller shaft;

a plurality of circumferentially spaced vanes mounted for rotation with said impeller shaft, said vanes extending outwardly relative to said impeller shaft and each including first and second axially-spaced edges;

first and second axially-spaced cover members for said plurality of vanes, said cover members being mounted for rotation with said impeller shaft and extending outwardly relative to the axial direction of said impeller shaft, said first cover member being disposed adjacent to said first edges of said vanes and said second cover member being disposed adjacent to said second edges of said vanes so as to provide an impeller chamber between said first and second cover members which is divided into subchambers by said vanes;

one of said first and second cover members having an opening therethrough arranged in alignment with said inlet of said pump housing for admitting fluid to be pumped into said impeller chamber to then be conducted outwardly upon rotation of said impeller shaft to said outlet of said pump housing; and said first cover member being so constructed and mounted relative to said vanes that a portion thereof is free to flex axially away from respective portions of said first edges of said vanes in response to fluid pressure pulsations within said impeller chamber to temporarily increase the distance between said portion of said first cover and said respective portions of said first edges of said vanes.

17. The centrifugal pump of claim 16, further including means for securely holding a radial inner portion of said first cover member in contact against a radially inner portion of said first edges of said vanes so that said portion of said first cover member which is free to flex axially away from said respective portions of said first edges of said vanes comprises a radially outer portion of said first cover member.

18. The centrifugal pump of claim 17, wherein said first cover member is shaped so that it normally conforms to and is in contact with said first edges of said vanes throughout the radial extent to said vanes.

19. The centrifugal pump of claim 17, wherein said first cover member is constructed and mounted relative to said vanes so as to form a small gap between the inner surface of said cover member and said respective portions of said first edges of said vanes during normal operation of said impeller, and so that the size of said small gap at a radially outer portion of said first cover member increases upon flexing of said portion of said first cover member away from said respective portions of said first edges of said vanes in response to fluid pressure pulsations within said impeller chamber.

20. An impeller for a centrifugal pump comprising:

a rotatable impeller shaft;

a plurality of circumferentially spaced vanes mounted for rotation with said impeller shaft, said vanes extending outwardly relative to said impeller shaft and each including first and second axially-spaced edges;

first and second axially-spaced cover members for said plurality of vanes, said cover members being mounted for rotation with said impeller shaft and extending outwardly relative to the axial direction of said impeller shaft, said first cover member being disposed adjacent to said first edges of said vanes and said second cover member being disposed adjacent to said second edges of said vanes so as to provide an impeller chamber between said first and second cover members which is divided into subchambers by said vanes;

one of said first and second cover members having a centrally disposed inlet opening therethrough for admitting fluid into said impeller chamber to then be conducted outwardly upon rotation of said impeller shaft; and said first cover member being so constructed and mounted relative to said vanes that a portion thereof is free to move away from respective portions of said first edges of said vanes in response to fluid pressure pulsations within said impeller chamber to provide a temporary passageway between said portion of said first cover member and said respective portions of said first edges of said vanes to thereby permit fluid in one of said subchambers to pass into an adjacent subchamber through said temporary passageway.

21. The impeller of claim 20 further including means for securely holding a radial inner portion of said first cover member in contact against a radially inner portion of said first edges of said vanes so that said portion of said first cover member which is free to flex axially away from said respective portions of said first edges of said vanes comprises a radially outer portion of said first cover member.

22. The impeller of claim 21 wherein said first cover member is shaped so that it normally conforms to and is in contact with said first edges of said vanes throughout the radial extent of said vanes.

23. The impeller of claim 21 wherein said first cover member is constructed and mounted relative to said vanes so as to form a small gap between the inner surface of said cover member and said respective portions of said first edges of said vanes during normal operation of said impeller, and so that the size of said small gap at a radially outer portion of said first cover member increases upon flexing of said portion of said first cover member away from said respective portions of said first edges of said vanes in response to fluid pressure pulsations within said impeller chamber.

* * * * *